United States Patent [19]

Anders et al.

[11] 4,401,154

[45] Aug. 30, 1983

[54] HEAT EXCHANGER CORE WITH END COVERS

[75] Inventors: Gene A. Anders, Peoria; Herbert J. Larson, Washington; Charles R. Miller, Metamora, all of Ill.

[73] Assignee: Caterpillar Tractor Co., Peoria, Ill.

[21] Appl. No.: 224,511

[22] PCT Filed: Nov. 7, 1980

[86] PCT No.: PCT/US80/01516

§ 371 Date: Nov. 7, 1980

§ 102(e) Date: Nov. 7, 1980

[87] PCT Pub. No.: WO81/01608

PCT Pub. Date: Jun. 11, 1981

Related U.S. Application Data

[63] Continuation-in-part of Ser. No. 133,635, filed as PCT/US79/01060, Dec. 3, 1979, § 102(e) Date, Dec. 3, 1979, abandoned.

[30] Foreign Application Priority Data

Dec. 3, 1979 [WO] PCT Int'l Appl. ... PCT/US79/01060

[51] Int. Cl.[3] ..... F28F 1/32

[52] U.S. Cl. ..... 165/151; 165/124

[58] Field of Search ..... 165/148, 149, 151, 124, 165/126, 125

[56] References Cited

U.S. PATENT DOCUMENTS

| | | | |
|---|---|---|---|
| 1,921,278 | 8/1933 | Young . | |
| 2,602,650 | 7/1952 | Marcotte . | |
| 3,478,821 | 11/1969 | Fieni | 165/151 X |
| 3,538,984 | 11/1970 | Kaserman | 165/182 |
| 4,034,804 | 7/1977 | Meijer et al. | 165/148 |

FOREIGN PATENT DOCUMENTS

| | | | |
|---|---|---|---|
| 2450093 | 7/1975 | Fed. Rep. of Germany | 165/151 |
| 788080 | 7/1935 | France | 165/151 |
| 2200888 | 4/1974 | France . | |
| 2250089 | 5/1975 | France . | |
| 2259341 | 8/1975 | France . | |

*Primary Examiner*—Albert W. Davis, Jr.
*Attorney, Agent, or Firm*—Anthony N. Woloch

[57] ABSTRACT

The outermost tubes (50) of a heat exchanger core (20) have not be as adequately cooled as have the interior tubes (50) by the flow of air between the fins (40) and the tubes (50). Herein, a cover (80 or 85) is connected over the edges (45) of the fins (40) defining a respective one of first and second end surfaces (70,75) and is spaced from the inlet surface (60) of the core (20). Consequently, the outermost tube (50), which is nearest the cover (80 or 85), is cooled substantially to the same degree as the other tubes (50). In one embodiment of the present invention, about a 5% increase in the thermal efficiency of the core (20) is attained.

13 Claims, 3 Drawing Figures

HEAT EXCHANGER CORE WITH END COVERS

This is a continuation-in-part of application Ser. No. 133,635, filed as PTC/U.S. 79/01060, Dec. 3, 1979, now abandoned.

DESCRIPTION

1. Technical Field

This invention relates to a heat exchanger, and, more particularly, to a core construction for increasing heat rejection and improving cooling.

2. Background Art

Heat exchangers, such as those used in earthmoving vehicles, must have sufficient capacity to cool the engine by the passage of air through and around the heat exchanger core. In the past, it has at times been necessary to use large fans operating at relatively high speeds to provide sufficient air flow through the heat exchanger core. Unfortunately, large fans may use excessive power and cause vibration and noise which is undesirable. Current noise regulations, in fact, restrict the use of large noisy fans so that other means must be found to provide effective cooling without excessive noise.

One way to increase cooling capacity is taught by Roelf J. Meijer and Jan Mulder in U.S. Pat. No. 4,034,804, which issued July 12, 1977. This patent discloses a radiator operable with a flow of air for cooling a quantity of water and formed as zig zag or folded walls, each of which contains air ducts. Cooling water tubes with elongated cross-sections are arranged in a number of flat cores being of the same width as the tube widths. The upper and lower sides of the cores are located in the front and rear planes, respectively, of the radiator. The cores are connected together alternately on their front and rear sides in an airtight manner. Similarly, FIG. 1B, page 866 of the technical paper, "A High Performance Radiator" by Asselman, Mulder, and Meijer presented at the 1972 Intersociety Energy Conversion Engineering Conference, shows core connection members which completely cover the ends of the fins.

The zig zag pattern increases the cooling capacity by increasing the radiator surface area exposed to the flow of air without increasing the frontal area of the radiator. However, a problem exists with the zig zag core patterns disclosed above in that the air-duct surfaces of the respective core connection members are shaped and positioned substantially differently than the air-duct surface of the respective cooling water tubes such that the outermost ducts at both ends of the cores, formed by the respective outermost tube, core connection member, and adjacent fins, do not provide the same resistance to air flow as the ducts formed between adjacent tubes and fins. Consequently, the outermost tubes at both ends of the cores are not cooled to the same degree as the other tubes. Hence, such folded or zig zag pattern cores have heretofore not been fully effectively utilized at or near their maximum cooling efficiency.

Another problem with such zig zag pattern cores is that the cores become plugged with debris at the apexes defined by the zig zag pattern. The aforementioned U.S. Pat. No. 4,034,804 provides one solution to this debris problem in the form of a fine gauze placed around the outside of each core. Another solution to this problem is set out in U.S. Pat. No. 4,116,265 which issued Sept. 26, 1978 to Paul Staebler. The Staebler patent discloses gaps between converging, adjacent cores which are closed by movable plugs during normal use and which are opened when periodic debris purging is performed. Another solution to this debris problem is set forth in U.S. Pat. No. 4,076,072 issued to Erwin Bentz on Feb. 28, 1978. The Bentz patent discloses a zig zag pattern of cores which are spaced apart a short distance so as to continually permit debris that would normally pile up in the converging trough to go on through.

It is therefore desirable to have a heat exchanger core which will more closely approach theoretical efficiency for cooling. It is also desirable to avoid the debris collection problem in such an efficient heat exchanger core.

The present invention is directed to overcoming one or more of the problems as set forth above.

DISCLOSURE OF INVENTION

In one aspect of the invention an improvement is provided in a heat exchanger which has a plurality of closely spaced fins having peripheral edges defining an inlet surface, an outlet surface and first and second end surfaces and having at least one cooling water tube having an elongated cross-section and extending through the fins and being spaced from the inlet surface. The improvement comprises a cover connected over the edges of the fins defining a respective one of said first and second end surfaces and being spaced from the inlet surface in order to cool the tube nearest the cover substantially to the same degree as the other tubes.

In another aspect of the invention, an improvement is provided in a heat exchanger having a second core in addition to the previously described first core and being mounted in a generally "V" configuration relative thereto with the first end surface of the two cores forming an apex of the "V". The improvement comprises a pair of covers connected over the edges defining the respective first and second end surfaces of each of the two cores and being spaced from the inlet surface thereof in order to cool each tube nearest the respective covers substantially to the same degree as the other tubes.

BEST MODE FOR CARRYING OUT THE INVENTION

Figure 1:
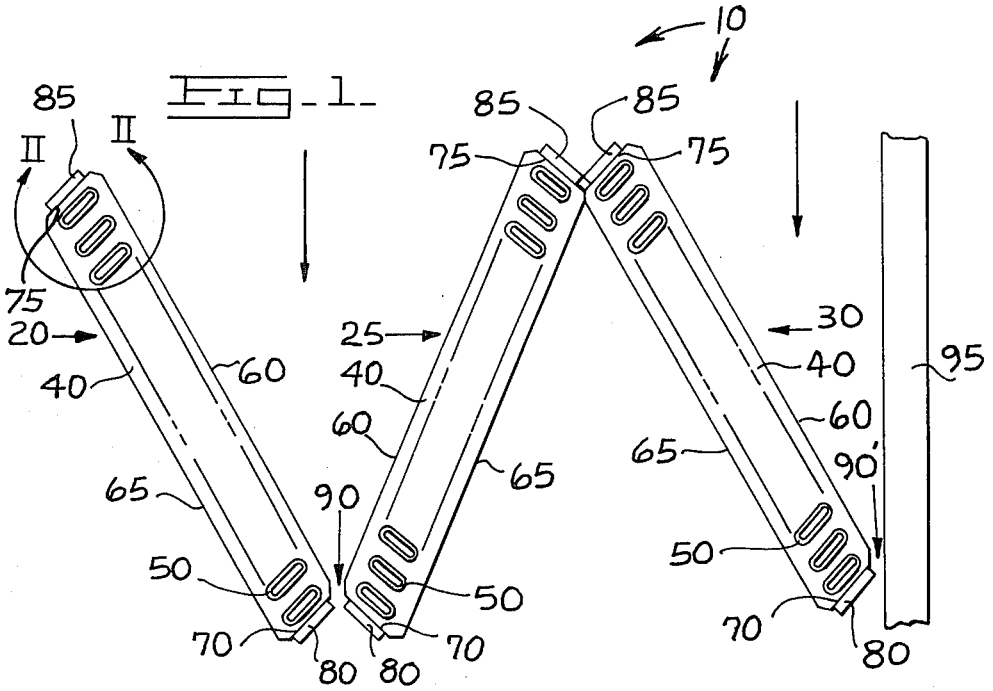
FIG. 1 is a top plan view of a heat exchanger embodiment of the present invention having a number of cores arranged in a zig zag or "V" pattern.

In FIG. 1, a self-purging heat exchanger 10 has a number of cores such as first, second and third cores 20,25,30 arranged in a zig zag or "V" pattern as viewed from the top. Air flow direction is as indicated by unnumbered arrows.

Figure 2:
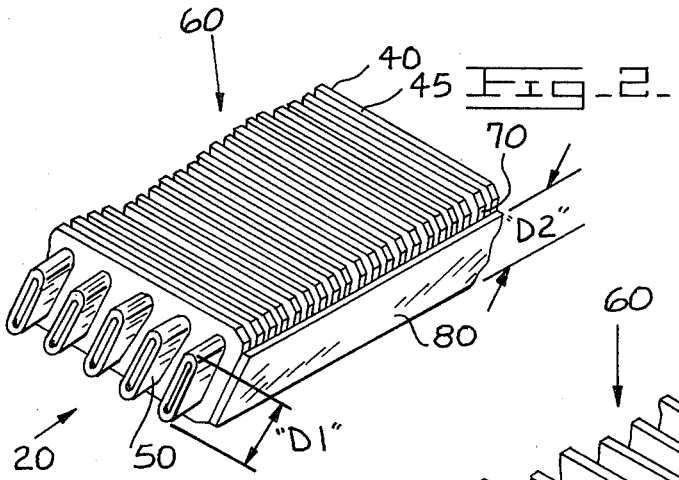
FIG. 2 is an isometric view showing a portion of an end surface of a heat exchanger core.

Each of the cores 20,25,30 is formed (see FIG. 2) of a plurality of fins 40 having peripheral edges 45 and at least one cooling water tube 50 being of elongated cross-section which extends through the fins 40. Referring once again to FIG. 1, each of the cores 20,25,30 has an inlet surface 60, an outlet surface 65, and first and second end surfaces 70,75, all of which are defined by the peripheral edges 45.

The tube 50 is spaced from the inlet surface 60 which is defined by the peripheral edges 45 of the fins 40. The cores 20,25 are angularly oriented to each other in a generally "V" configuration with an included angle of generally between 20° and 80° for efficient cooling and space utilization. In this configuration, the inlet surface 60 of each core 20,25 is positioned generally at an angle between 10° and 40° with the flow of air approaching the inlet surface. The first end surfaces 70 of the cores 20 and 25 are adjacent to one another. A small gap 90 will generally be present between the first end surfaces 70 of the cores 20,25. The gap 90 is generally sized to allow debris, but not too much air, to flow therethrough. Where there is an end core such as the third core 30, a gap 90' will generally be present between a frame member 95 and the first end surface 70 of the core 30. Moreover, gap 90' will generally have a size approximately equal to that of the gap 90.

In accordance with the present invention, each of the cores 20,25,30 has a pair of covers 80,85 which are substantially parallel to the tube 50 and are connected over the edges 45 of the fins 40 which define the respective first 70 and second 75 end surfaces of the respective cores 20,25,30. In each of the cores 20,25,30, the leading edge of the tube 50 and the covers 80,85 are spaced from the inlet surface 60 substantially the same distance in order to provide efficient cooling without excessive turbulence and also to facilitate sliding and rolling of debris toward the bottom of the vee. Moreover, the covers, for example 80 (see FIG. 2), generally have a dimension "D2" approximately equal to the dimension "D1" of the tube 50.

Preferably, there are a plurality of generally equally spaced tubes 50 and the spacing, between each of the outermost tubes 50 and adjacent covers 80,85 is substantially equal to half the spacing between adjacent parallel tubes 50. In such a situation, the outermost tubes 50 are cooled substantially to the same degree as are any of the other tubes 50. It is also preferred that the tubes 50 and the covers 80,85 are spaced substantially the same distance from the outlet surface 65 in each of the respective cores 20,25,30 to provide efficient cooling.

ALTERNATE EMBODIMENT

Figure 3:
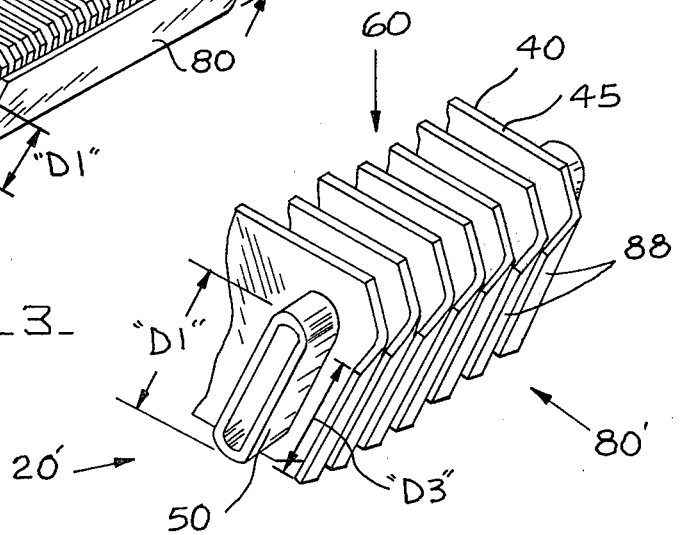
FIG. 3 is an enlarged partial view, similar to FIG. 2, and showing an alternate embodiment of the present invention.

Turning to FIG. 3, there is partially shown therein an alternate embodiment of the present invention wherein each of the cores 20',25',30' has a pair of covers 80',85' which are formed of a plurality of tabs 88. Each of the tabs 88 are extensions of the respective first and second end surfaces 70,75 of the respective cores 20',25',30'. Moreover, each tab 88 is bent over in the same direction and generally parallel to the respective tubes 50. Each of the tabs 88 generally has a tab dimension "D3" approximately equal to the dimension "D1" of the tube 50 and the spacing of the tabs 88 from the inlet surface 60 is substantially equal to the spacing of the tube 50 from the inlet surface 60. Covers 80',85' function substantially the same as the above described covers 80,85.

INDUSTRIAL APPLICABILITY

During operation, air approaches the heat exchanger 10 from the direction shown by the arrows in FIG. 1. The air then passes via inlet surfaces 60 and through air ducts formed between adjacent tubes 50 and adjacent fins 40 and then out the outlet surfaces 65. Air passing via inlet surfaces 60 adjacent the first and second end surfaces 70,75 passes through air ducts formed between each of the covers 80,85, a nearest tube 50, and adjacent fins 40 and out the outlet surfaces 65.

Improved heat exchanger cores in accordance with the invention provide much improved cooling of the tubes nearest the end surfaces of the core. This, in turn, provides a larger (approximately 5% in one embodiment of the present invention) cooling capacity for the entire heat exchanger assembly. By spacing cover 85 from the inlet surface, cover 85 does not block air flow to the adjacent tube 50. By spacing cover 80 from the inlet surface, any debris passing through the gap 90 does not hang up thereon and is readily purged from the radiator. When, in accordance with one embodiment of the invention, there are a pair of the cores "V" configuration, and when there is a gap 90 between the pair of cores, debris is readily purged from the assembly.

Such heat exchanger cores are as disclosed herein are useful as cores for radiators such as those used in vehicles, particularly earthmoving vehicles.

Other aspects, objects and advantages of this invention can be obtained from a study of the drawings, the disclosure and the appended claims.

We claim:

1. In a heat exchanger core (20) having a plurality of closely spaced fins (40) having peripheral edges (45) defining an inlet surface (60), an outlet surface (65), and first and second end surfaces (70,75) and having at least one tube (50) extending through the fins (40) and being spaced from said inlet surface (60), said tube (50) having an elongated cross-section, said inlet surface (60) positioned generally at an angle between 10° and 40° with the flow of air to the inlet surface (60), the improvement comprising:

a cover (80 or 85) connected over the edges (45) of said fins (40) which define a respective one of said first and second end surfaces (70,75) and being spaced from said inlet surface (60) a distance substantially equal to the spacing of the tube (50) from the inlet surface (60), said cover (80 or 85) being substantially parallel to the tube (50).

2. The heat exchanger core (20) as in claim 1, futher including:

a second cover (85 or 80) connected over the edges (45) of said fins (40) which define a respective other of said second and first end surfaces (75,70) and being spaced from said inlet surface (60) a distance substantially equal to the spacing of the tube (50) from the inlet surface (60), said second cover (85 or 80) being substantially parallel to the tube (50).

3. The heat exchanger core (20) as in claim 1, wherein said tube (50) generally has a tube dimension ("D1") and wherein said cover (80 or 85) has a cover dimension ("D2") substantially equal to the tube dimension ("D1").

4. The heat exchanger core (20) as in claim 1, wherein the tube (50) is spaced from the outlet surface (65) and the cover (80 or 85) is spaced from the outlet surface (65) a distance substantially equal to the spacing of the tube (50) from the outlet surface (65).

5. The heat exchanger core (20) as in claim 1, wherein there are a plurality of said tubes (50) and the spacing between said cover (80 or 85) and a nearest of the tubes (50) is substantially equal to half the spacing of adjacent parallel tubes (50).

6. The heat exchanger core (20) as in claim 1, wherein said cover (80' or 85') is formed of a plurality of tabs (88) which extend from said peripheral edges (45) at said respective first and second end surfaces (70,75) and are bent over generally parallel to the tube (50), said tabs (88) being spaced from the inlet surface (60) a distance substantially equal to the spacing of the tube (50) from the inlet surface (60).

7. The heat exchanger core (20) as in claim 6 wherein said tube (50) has a tube dimension ("D1") and said cover (80' or 85') has a tab dimension ("D3") substantially equal to the tube dimension ("D1").

8. In a heat exchanger (10) having first (20) and second (25) cores each having a plurality of closely spaced fins (40) having peripheral edges (45) defining an inlet surface (60), an outlet surface (65) and first (70) and second (75) end surfaces and each core (20,25) having at least one tube (50) extending through the fins (40) and being spaced from said respective inlet surface (60), said tubes (50) having an elongated cross-section, said cores (20,25) being mounted in a generally "V" configuration with said first end surfaces (70) defining an apex of said "V", the improvement comprising:

a plurality of covers (80,85) connected over the edges (45) of said fins (40) which define said respective first and second end surfaces (70,75) of said respective cores (20,25) and being spaced from said inlet surface (60) of the respective cores (20,25) a distance substantially equal to the spacing of the respective tube (50) from the inlet surface (60), said covers (80,85) of the cores (20,25) being substantially parallel to the tube (50) of the respective cores (20,25).

9. The heat exchanger (10) as in claim 8, wherein said covers (80,85) of the respective cores (20,25) are spaced from said outlet surface (65) of the respective cores (20,25) a distance substantially equal to the spacing of the respective tube (50) from the outlet surface (65).

10. The heat exchanger (10) as in claim 8, wherein said tube (50) generally has a tube dimension ("D1") and wherein said covers (80,85) have a cover dimension ("D2") substantially equal to the tube dimension ("D1").

11. The heat exchanger (10) as in claim 8, wherein said covers (80',85') of the cores (20,25) are each formed of a plurality of tabs (88) which extend from said peripheral edges (45) at said respective first and second end surfaces (70,75) and which are bent over generally parallel to said tubes (50) of the respective cores (20,25), said tabs (88) being spaced from the inlet surface (60) of the respective cores (20,25) a distance substantially equal to the spacing of the respective tube (50) from the inlet surface (60).

12. The heat exchanger (10) as in claim 8, wherein each of said cores (20,25) includes a plurality of said tubes (50) generally equally spaced from one another and wherein the separation between each of said covers (80,85) and the respective nearest adjacent tube (50) is substantially equal to half the spacing between the adjacent parallel tubes (50).

13. The heat exchanger (10) as in claim 11 wherein said tubes (50) each have a tube dimension ("D1") and said covers (80',85') each have a tab dimension ("D3") substantially equal to the tube dimension ("D1").

* * * * *